US009375035B1

(12) United States Patent
Ingels

(10) Patent No.: US 9,375,035 B1
(45) Date of Patent: Jun. 28, 2016

(54) SYSTEM FOR MALE GENITAL SUPPORT AND ENHANCING APPEARANCE

(71) Applicant: Jonkeo D. Ingels, New York, NY (US)

(72) Inventor: Jonkeo D. Ingels, New York, NY (US)

( * ) Notice: Subject to any disclaimer, the term of this patent is extended or adjusted under 35 U.S.C. 154(b) by 0 days.

(21) Appl. No.: 14/529,800

(22) Filed: Oct. 31, 2014

(51) Int. Cl.
*A41B 9/02* (2006.01)
*A41B 9/08* (2006.01)
*A41B 9/00* (2006.01)

(52) U.S. Cl.
CPC . *A41B 9/02* (2013.01); *A41B 9/004* (2013.01); *A41B 9/023* (2013.01)

(58) Field of Classification Search
CPC ... A41B 9/00–9/001; A41B 9/04; A41B 9/07; A41B 9/08; A41B 9/02; A41B 11/00
USPC ..... 2/78.1–78.3, 401–405, 408
See application file for complete search history.

(56) References Cited

U.S. PATENT DOCUMENTS

| | | | | |
|---|---|---|---|---|
| 2,369,773 | A * | 2/1945 | Brenner | 2/403 |
| 4,695,279 | A * | 9/1987 | Steer | 604/397 |
| 5,669,902 | A * | 9/1997 | Sivilich | 604/396 |
| 6,901,607 | B1 * | 6/2005 | Elwell | 2/403 |
| 8,230,526 | B2 * | 7/2012 | Holland et al. | 2/403 |
| 2012/0180198 | A1 * | 7/2012 | Ruggieri | 2/403 |
| 2012/0260404 | A1 * | 10/2012 | Steele | 2/404 |

* cited by examiner

*Primary Examiner* — Robert J Hicks
*Assistant Examiner* — Timothy K Trieu

(57) ABSTRACT

A male bottom garment with a compartment for supporting and enhancing the appearance of male genitals, the genitals being the scrotum and the penis. The compartment is disposed near the front crotch region of the male bottom garment. The compartment is a formed by two, partially overlapping support straps attached to the garment at least at the strap tip and strap base edge. The base of each support strap is wider than its upper tips so as to support the male genitals.

12 Claims, 5 Drawing Sheets

SYSTEM FOR MALE GENITAL SUPPORT AND ENHANCING APPEARANCE

FIELD OF THE INVENTION

The present invention relates to clothing for male genital support, in particular, men's bottom garment having a compartment for supporting and enhancing the appearance of the male genitalia.

BACKGROUND OF THE INVENTION

Men's bottom garments, such as briefs, boxers, and swim wear, offer little to no support of the male genitals, and merely acts as a soft barrier against the rougher fabrics of the outer clothing. Due to body sweat, the freely hanging scrotum and penis tend to stick to and/or rub against a man's thighs. As this can be uncomfortable and irritating, men may feel a need to constantly adjust their genitals. Also, the friction from the rubbing may cause itchiness that could lead to a man scratching his genitals and further causing rashes or breaking of the skin. Moreover, when a man adjusts or scratches his genitals in public to ease his discomfort, albeit discretely, the man or possibly people witnessing him perform the action may feel embarrassed. Hence, there is a need for a male genital support system that would resolve these issues.

Along with lacking support, men's bottom garments may press the genitals against the body, thereby diminishing the appearance of the male genital bulge under the clothing. As some men have a desire to appear larger and/or show their penis outline under the clothing to attract a mate, the minimal bulge or lack thereof may reduce their chances of doing so. Hence, there is a need for a male genital support system that would further enhance the appearance of the genitals.

SUMMARY OF THE INVENTION

The present invention features a male bottom garment having a genital support pouch. The male bottom garment comprises at least a torso opening, a left leg opening, and a right leg opening. The genital support pouch comprises two pouch straps attached to an inner front surface of the male bottom garment. The pouch straps support the male genitals and prevent them from being rubbed against the thigh skin. The genital support pouch uplifts the male genitals to enhance their appearance. The male bottom garment may be any article of clothing that is in direct contact with the male genitals.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
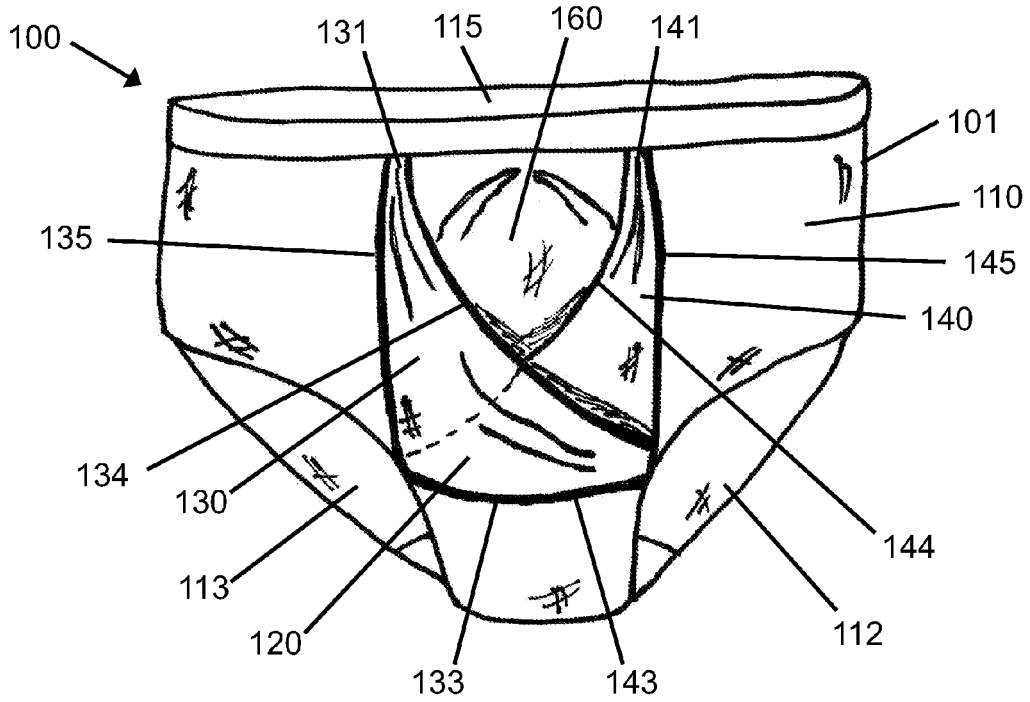
FIG. 1 shows a front view of the present invention when the male bottom garment is turned inside out.
Figure 2:
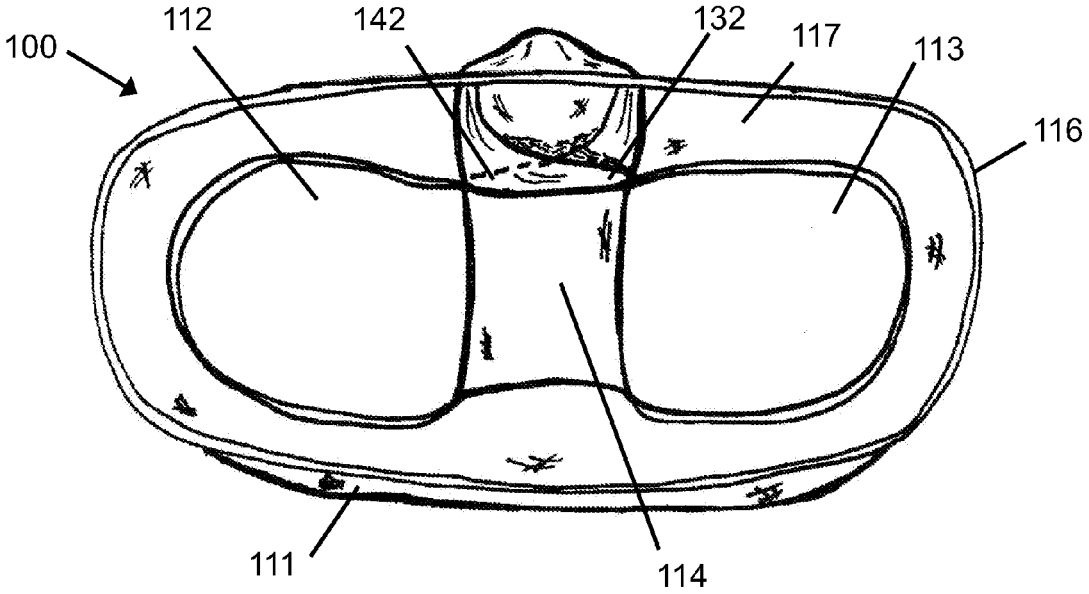
FIG. 2 shows a top view of the present invention.
Figure 3:
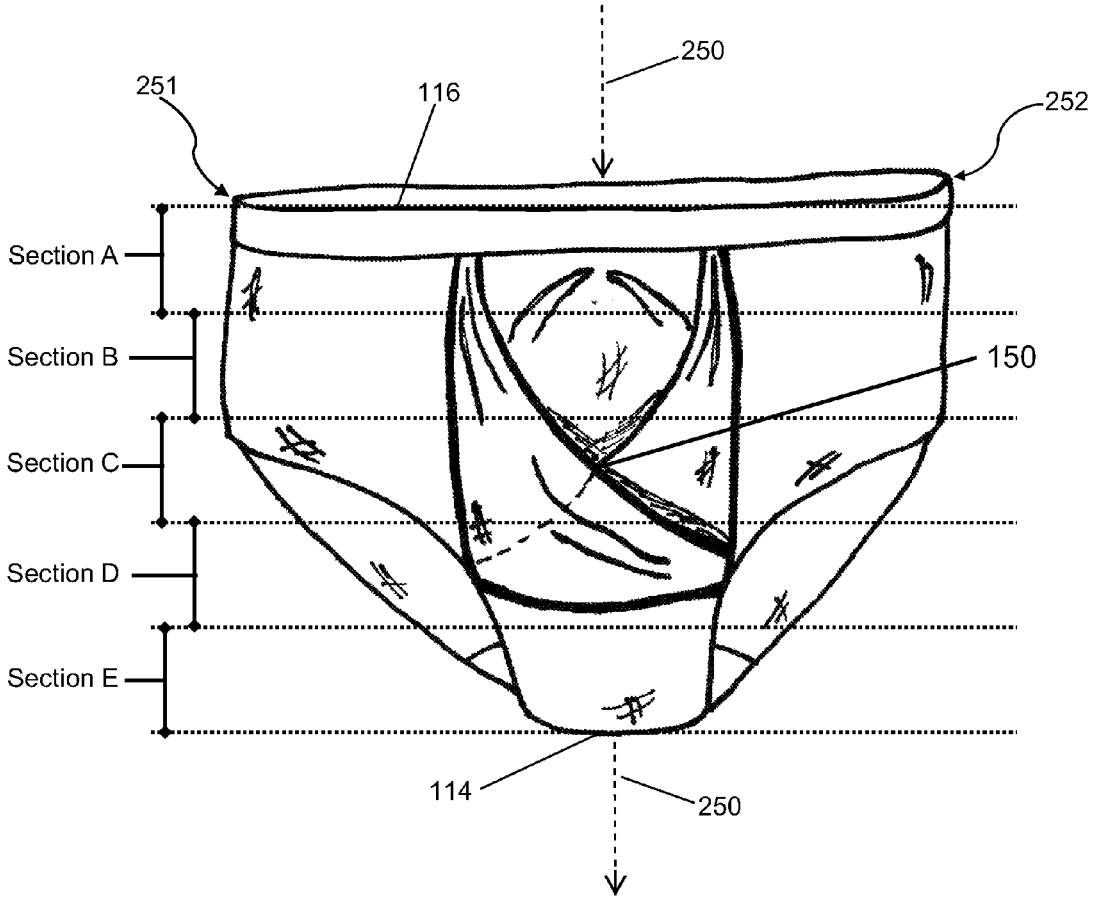
FIG. 3 shows the five sections of the male bottom garment as turned inside out.
Figure 4:
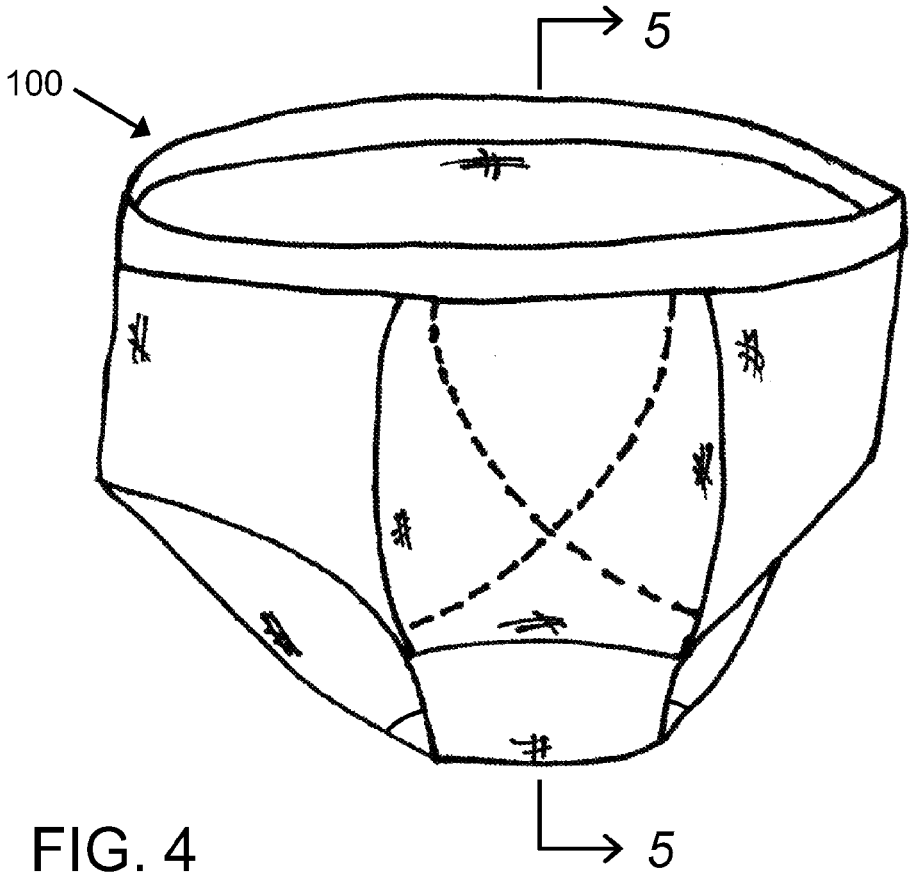
FIG. 4 shows perspective view of the present invention.

Following is a list of elements corresponding to a particular element referred to herein:

100 male genital support system
101 male bottom garment
110 front panel
111 back panel
112 left leg opening
113 right leg opening
114 crotch bottom
115 torso opening
116 torso opening edge
117 inner surface
120 genital support pouch
130 first pouch strap
131 first upper tip
132 first lower base
133 first base edge
134 first diagonal edge
135 first vertical side edge
140 second pouch strap
141 second upper tip
142 second lower base
143 second base edge
144 second diagonal edge
145 second vertical side edge
150 point of intersection
160 pouch opening
200 male genitals
section A first section
section B second section
section C third section
section D fourth section
section E fifth section Referring now to FIG. 1-7, the present invention features a male genital support system (100) for supporting and enhancing appearance of a male genitals (200). In some embodiments, the system (100) comprises a male bottom garment (101) and a genital support pouch (120) for carrying the male genitals (200). In some embodiments, the male bottom garment comprises a front panel (110), a back panel (111), a left leg opening (112), a right leg opening (113), a crotch bottom (114), and a torso opening (115) bounded by a torso opening edge (116). In some embodiments, between the torso opening edge (116) and the crotch bottom (114), the male bottom garment (101) is divided into five sections (section A, B, C, D, E). In some embodiments, the five sections are equal in width. In some embodiments, the genital support pouch (120) is disposed on an inner surface (117) of the front panel (110).

In some embodiments, the pouch (120) comprises a first pouch strap (130) and a second pouch strap (140). In some embodiments, the first pouch strap comprises a narrow first upper tip (131) flaring downwardly to a broader first lower base (132). In some embodiments, the first upper tip (131) is disposed in the first section (section A) above the right leg opening (113). In some embodiments, the first upper tip (131) is attached to the inner surface (117). In some embodiments, a first base edge (133) of the first lower base (132) is disposed in the fourth section (section D) and attached to the inner surface (117).

In some embodiments, the second pouch strap (140) comprises a narrow second upper tip (141) flaring downwardly to a broader second lower base (142). In some embodiments, the second upper tip (141) is disposed in the first section (section A) above the left leg opening (112). In some embodiments, the second upper tip (141) is attached to the inner surface (117). In some embodiments, a second base edge (143) of the second lower base (142) is disposed in the fourth section (section D) and attached to the inner surface (117). In some embodiments, the first pouch strap (130) and second pouch strap (140) may be triangular-shaped, L-shaped, trapezoidal-shaped, or preferably, a shape having a base wider than its top.

Figure 5:
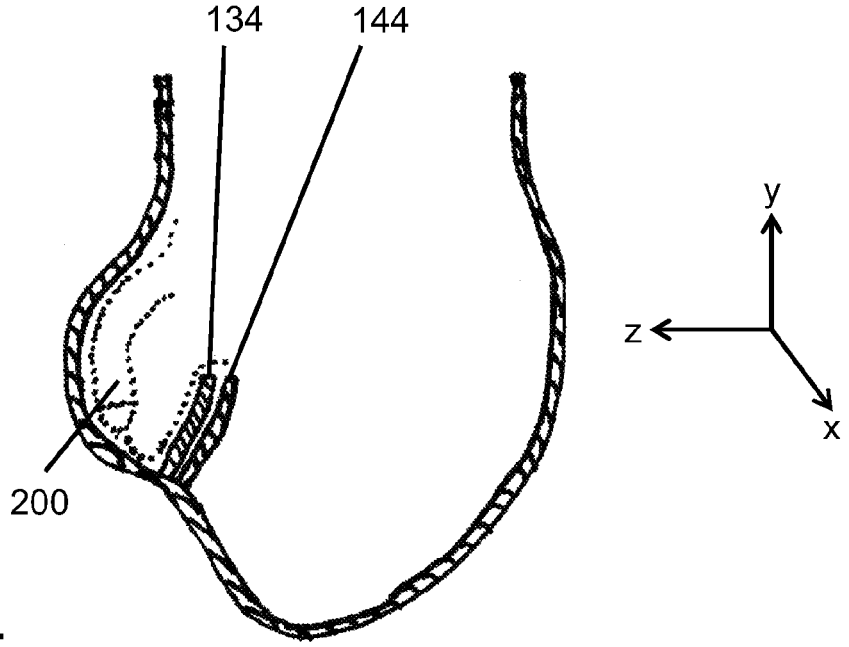
FIG. 5 shows a cross-sectional view of the present invention with respect to FIG. 4.
Figure 6:
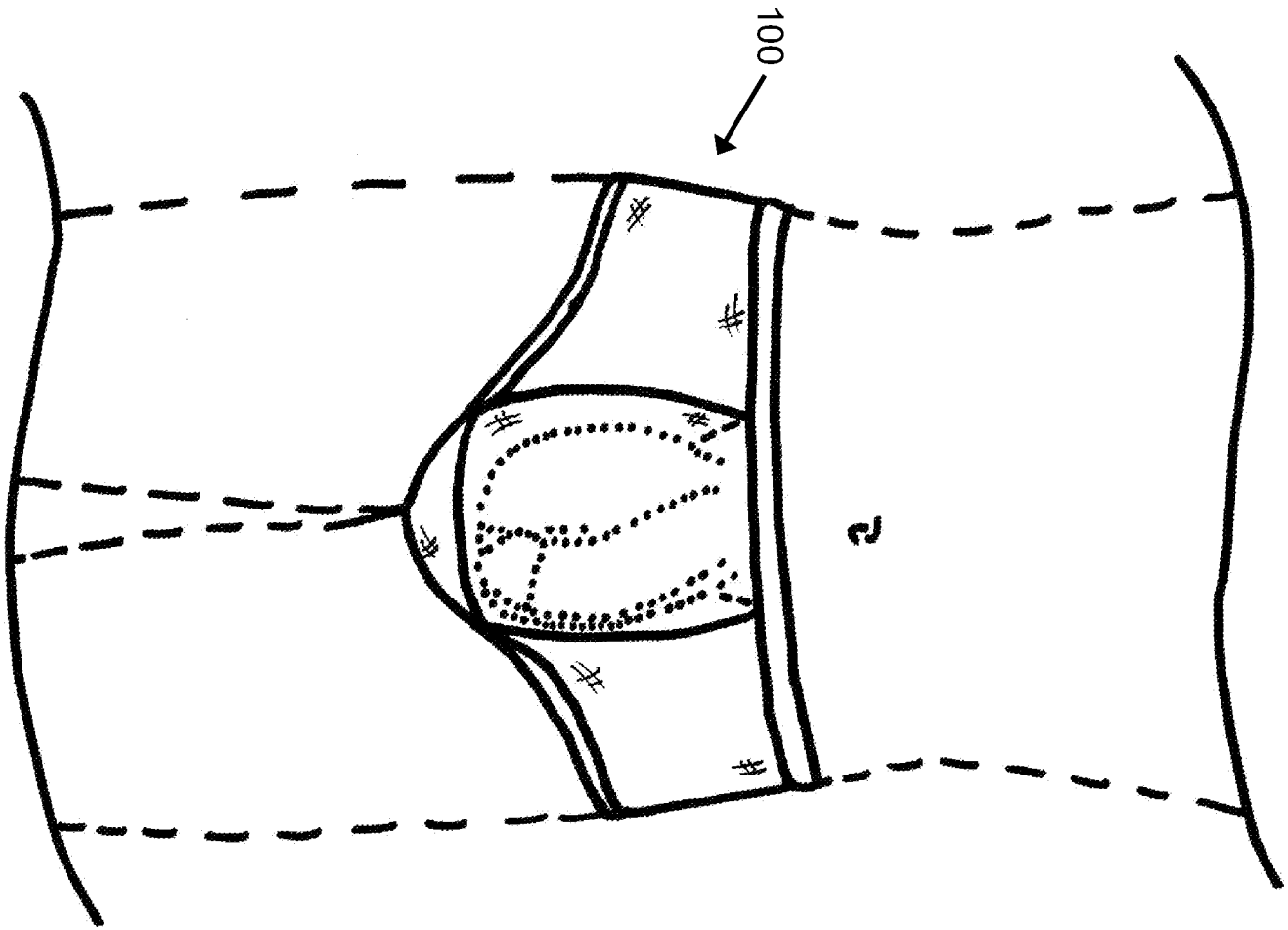
FIG. 6 shows an in-use view the present invention.
Figure 7:
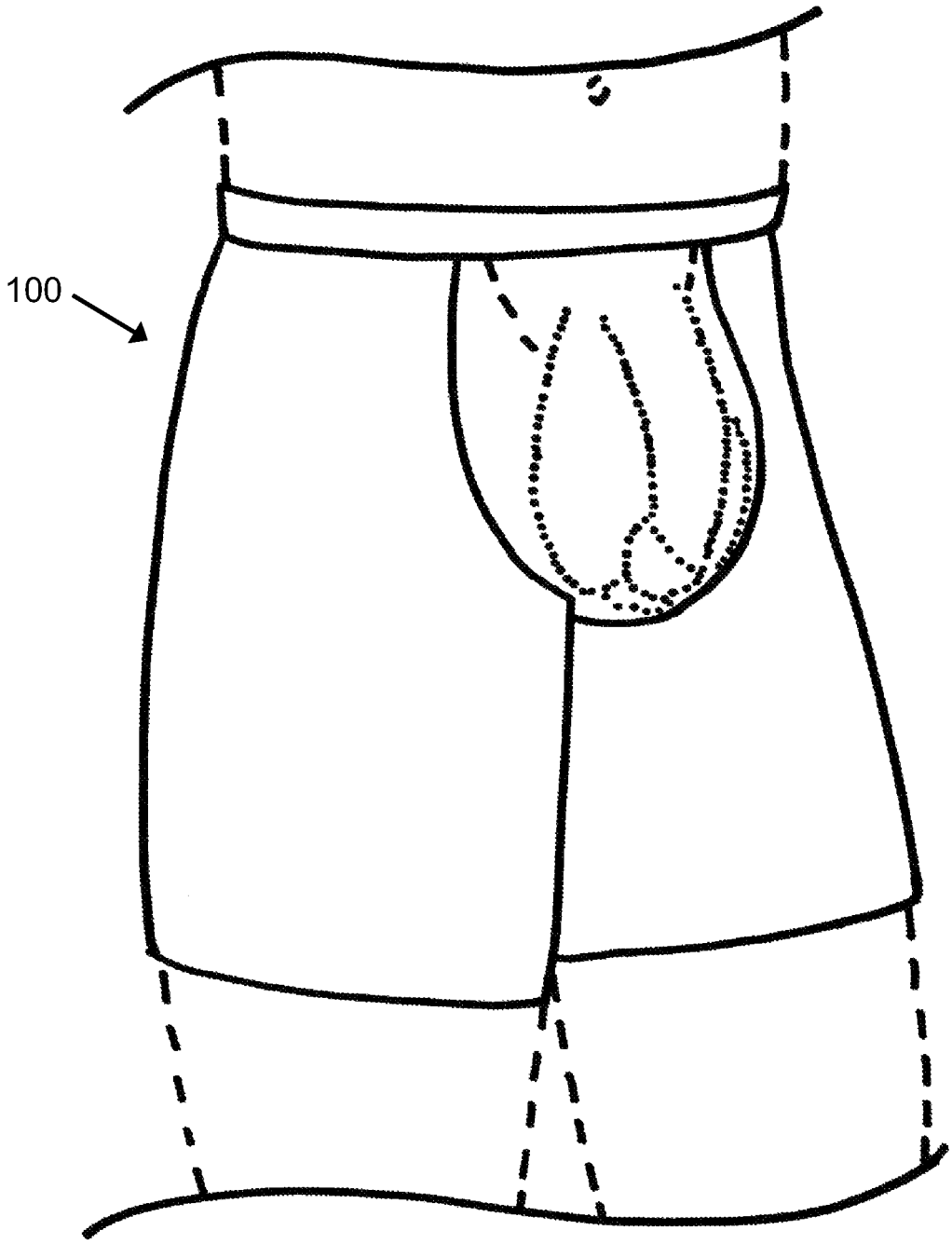
FIG. 7 shows an in-use view of an alternative embodiment of the present invention.

In some embodiments, a first diagonal edge (134) of the first pouch strap (130) and a second diagonal edge (144) of the second pouch strap (140) intersect at a point (150) to form an "X". As seen in FIG. 5, in some embodiments, the first diagonal edge (134) and the second diagonal edge (145) provide two separate supports by individually hoisting the male genitals (200) in a z-axis direction. In preferred embodiments, this feature allows for the weight of the male genitals to be distributed between the two diagonal edges so as to minimize the pressure applied on the genitals by the diagonal edges. In another preferred embodiment, this feature allows for air to circulate between the male genitals and the surrounding skin near the perineum.

In some embodiments, the point of intersection (150) is disposed in the third section (section C). In some embodiments, the first pouch piece (130) overlaps the second pouch piece (140) at and below the point of intersection (150). In some embodiments, the male genitals (200) are placed in the genital support pouch (120) via a pouch opening (160) disposed above the point of intersection (150) and between the first diagonal edge (134) and the second diagonal edge (144). In some embodiments, the pouch opening is sufficiently sized to allow for the genitals to enter the pouch without constricting around the genitals so as to interfere with blood circulation to the genitals. In some embodiments, the point of intersection (150) is at or near a center line (250) that lies between a first side (251) and a second side (252).

In some embodiments, the first pouch strap (130) and second pouch strap (140) substantially overlap to cover the male genitals (200), thereby preventing the male genitals (200) from contacting a skin of a thigh. In some embodiments, the first pouch strap (130) and second pouch strap (140) provides a secure barrier between the genitals and the thigh skin. Without wishing to limit the present invention to a particular mechanism, it is believed that the feature of the double flaps of the genital pouch ensures that the genitals will not escape from the pouch. Also, the double flaps provide a comfortable hammock-like support of the genitals.

Again, without wishing to limit the present invention, it is believed that the double flaps of the genital pouch provide additional lifting of the male genitals. When the male genitals are placed in the pouch, the weight of the genitals applied to both the first and second panels causes both base edges to pull on the front panel. The combined pulling motion from both base edges substantially lifts the genitals higher as compared to a single flap pouch. In a preferred embodiment, the male genitals are lifted higher up so as to reduce contact with the thighs. In another preferred embodiment, the male genitals are lifted higher up so as to enlarge their appearance and pronounce their shape under the outer clothing.

In some embodiments, a first vertical side edge (135) of the first pouch strap (130) is disposed above the right leg opening (113) and attached to the inner surface (117) between the first section (section A) and the fourth section (section D). In some embodiments, a second vertical side edge (145) of the second pouch strap (140) is disposed above the left leg opening (112) and attached to the inner surface (117) between the first section (section A) and the fourth section (section D).

In some embodiments, the first diagonal edge (134) and the second diagonal edge (144) is elasticized. In some embodiments, the first diagonal edge and the second diagonal edge may be shaped concavely up so as to provide a cupping support of genitals. In some embodiments, the pouch opening (160) is "U" or "V" shaped. In some embodiments, the torso opening edge (116) comprises an elasticized waistband.

In some embodiments, the male bottom garment (101) is constructed from cotton, polyester, silk, viscose, elastane, wool, fleece, or a combination thereof. As a non-limiting example, the garment may be constructed of about 100% organic cotton. In another example, the garment may be constructed of about 80% cotton and about 20% polyester. In some embodiments, the garment may contain about 5% elastane to allow the garment to stretch comfortably.

In some embodiments, the male bottom garment (101) is an underwear, a swimwear, a sleepwear, an exercise wear or a sportswear. In some embodiments, the swim wear may be a swim trunk, a swim shorts, a swim brief, or a swim suit. In some embodiments, the sleep wear may be a pajama bottom, a lounge pants, or a lounge shorts. In some embodiments, the exercise wear may be exercise shorts or exercise pants. In some embodiments, the sportswear may be a leggings, sports pants such as jogging or sweat pants, sports shorts such as running shorts, basketball shorts, or board shorts. In some embodiments, the present invention can be used for medical purposes.

In some embodiments, the present invention features a male underwear garment (101) having a genital support pouch (120) for supporting and enhancing appearance of a male genitals (200). In some embodiments, the male underwear garment (100) is a brief, a boxer, a boxer-brief, a jockstrap, a trunk, a g-string, a thong, a singlet, or a long underwear.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A male genital support system (100) for supporting and enhancing appearance of a male genitals (200), said system (100) comprising:

a) a male bottom garment (101) comprising a front panel (110), a back panel (111), a left leg opening (112), a right leg opening (113), a crotch bottom (114), and a torso opening (115) bounded by a torso opening edge (116); wherein between the torso opening edge (116) and the crotch bottom (114), the male bottom garment (101) is divided into five sections (section A, B, C, D, E) of equal width; and b) a genital support pouch (120) for carrying the male genitals (200), the pouch (120) is disposed on an inner surface (117) of the front panel (110), said pouch (120) comprises:

(i) a first pouch strap (130) having a narrow first upper tip (131) flaring downwardly to a broader first lower base (132), wherein the first upper tip (131) is disposed in the first section (section A) above the right leg opening (113), wherein the first upper tip (131) is attached to the inner surface (117), wherein a first base edge (133) of the first lower base (132) is disposed in the fourth section (section D) and attached to the inner surface (117); wherein a bottom end of a first vertical side edge (135) of the first pouch strap (130) is disposed above the middle portion of the right leg opening (113) and the first vertical side edge (135) is attached to the inner surface (117) between the first section (section A) and the fourth section (section D); and (ii) a second pouch strap (140) having a narrow second upper tip (141) flaring downwardly to a broader second lower base (142), wherein the second upper tip (141) is disposed in the first section (section A) above the left leg opening (112), wherein the second upper tip (141) is attached to the inner surface (117), wherein a second base edge (143) of the second lower base (142) is disposed in the fourth section (section D) and attached to the inner surface (117); wherein a bottom end of a second vertical side edge (145) of the second pouch strap (140) is disposed above the middle portion of the left leg opening (112) and the second vertical side edge (145) is attached to the inner surface (117) between the first section (section A) and the fourth section (section D);

wherein a first diagonal edge (134) of the first pouch strap (130) and a second diagonal edge (144) of the second pouch strap (140) intersect at a point (150) to form an "X", wherein the point of intersection (150) is disposed in the third section (section C), wherein the first pouch strap (130) overlaps the second pouch strap (140) at and below the point of intersection (150);

wherein the male genitals (200) are placed in the genital support pouch (120) via a pouch opening (160) disposed above the point of intersection (150) and between the first diagonal edge (134) and the second diagonal edge (144) when the garment is worn; wherein the pouch opening (160) forms a "U" or "V" shaped structure; wherein a total surface area of the genital support pouch (120) is disposed between the first section (section A) and the fourth section (section D); wherein the first pouch strap (130) and second pouch strap (140) substantially overlap to cover the male genitals (200), thereby preventing the male genitals (200) from contacting a skin of a thigh; and wherein the first pouch strap (130) and the second pouch strap (140) of the genital support pouch (120) uplift the male genitals in Z-axis direction to enhance their appearance by maximising genital outlines under a clothing when the garment is worn.

2. The male genital support system (100) of claim 1, wherein the male bottom garment (101) is an underwear, a swimwear, a sleepwear, an exercise wear, a sportswear, or for medical use.

3. The made genital support system (100) of claim 1, wherein the first diagonal edge (134) and the second diagonal edge (144) provide two separate supports by individually hoisting the male genitals (200) in a z-axis direction when the garment is worn.

4. The male genital support system (100) of claim 1, wherein the first diagonal edge (134) and the second diagonal edge (144) is elasticized.

5. The male genital support system (100) of claim 1, wherein the torso opening edge (116) comprises an elasticized waistband.

6. The male genital support system (100) of claim 1, wherein the male bottom garment (101) is constructed from cotton, polyester, silk, viscose, spandex, wool, fleece, or a combination thereof.

7. A male underwear garment (101) for supporting and enhancing appearance of a male genitals (200), said underwear garment (101) comprising:

a) a front panel (110);

b) a back panel (111);

c) a left leg opening (112);

d) a right leg opening (113);

e) a crotch bottom (114);

f) a torso opening (115) bounded by a torso opening edge (116), wherein between the torso opening edge (116) and the crotch bottom (114), the male underwear garment (100) is divided into five sections (section A, B, C, D, E) of equal width; and g) a genital support pouch (120) disposed on an inner surface (117) of the front panel (110), said pouch (120) comprising:

(i) a first pouch strap (130) having a narrow first upper tip (131) flaring downwardly to a broader first lower base (132), wherein the first upper tip (131) is disposed in the first section (section A) above the right leg opening (113), wherein the first upper tip (131) is attached to the inner surface (117), wherein a first base edge (133) of the first lower base (132) is disposed in the fourth section (section D) and attached to the inner surface (117); wherein a bottom end of a first vertical side edge (135) of the first pouch strap (130) is disposed above the middle portion of the right leg opening (113) and the first vertical side edge (135) is attached to the inner surface (117) between the first section (section A) and the fourth section (section D); and (ii) a second pouch strap (140) having a narrow second upper tip (141) flaring downwardly to a broader second lower base (142), wherein the second upper tip (141) is disposed in the first section (section A) above the left leg opening (112), wherein the second upper tip (141) is attached to the inner surface (117), wherein a second base edge (143) of the second lower base (142) is disposed in the fourth section (section D) and attached to the inner surface (117); wherein a bottom end of a second vertical side edge (145) of the second pouch strap (140) is disposed above the middle portion of the left leg opening (112) and the second vertical side edge (145) is attached to the inner surface (117) between the first section (section A) and the fourth section (section D) wherein a first diagonal edge (134) of the first pouch strap (130) and a second diagonal edge (144) of the second pouch strap (140) intersect at a point (150) to form an "X", wherein the point of intersection (150) is disposed in the third section (section C), wherein the first pouch strap (130) partly overlaps the second pouch strap (140) at and below the point of intersection (150); wherein the male genitals (200) are placed in the genital support pouch (120) via a pouch opening (160) disposed above the point of intersection (150) and between the firs diagonal edge (134) and the second diagonal edge (144) when the garment is worn; wherein the pouch opening (160) forms a "U" or "V" shaped structure; wherein a total surface area of the genital support pouch (120) is disposed between the first section (section A) and the fourth section (section D): wherein the first pouch strap (130) and second pouch strap (140) substantially overlap to cover the male genitals (200), thereby preventing the male genitals (200) from contacting a skin of a thigh: and wherein the first pouch strap (130) and the second pouch strap (140) of the genital support pouch (120) uplift the male genitals in Z-axis direction to enhance their appearance by maximising genital outlines under a clothing when the garment is worn.

8. The male underwear garment (101) of claim 7, wherein the male underwear garment (101) is a brief, a boxer, a boxer-brief, a jockstrap, a trunk, a g-string, a thong, a singlet, or a long underwear.

9. The male underwear garment (101) of claim 7, wherein the first diagonal edge (134) and the second diagonal edge (144) provide two separate supports by individually hoisting the male genitals (200) in a z-axis direction when the garment is worn.

10. The male underwear garment (101) of claim 7, wherein the first diagonal edge (134) and the second diagonal edge (144) is elasticized.

11. The male underwear garment (101) of claim 7, wherein the torso opening edge (116) comprises an elasticized waistband.

12. The male underwear garment (101) of claim 7, wherein the male bottom garment (101) is constructed from cotton, polyester, silk, viscose, spandex, wool, fleece, or a combination thereof.

* * * * *